US007331749B2

(12) United States Patent
Vachon

(10) Patent No.: US 7,331,749 B2
(45) Date of Patent: Feb. 19, 2008

(54) BACKHOE FOR ALL-TERRAIN VEHICLES

(76) Inventor: Roger Vachon, 308, Ave des Chenes, Ste-Marie (CA) G6E 1Z4

( * ) Notice: Subject to any disclaimer, the term of this patent is extended or adjusted under 35 U.S.C. 154(b) by 192 days.

(21) Appl. No.: 11/228,218

(22) Filed: Sep. 19, 2005

(65) Prior Publication Data

US 2006/0104785 A1 May 18, 2006

(30) Foreign Application Priority Data

Sep. 20, 2004 (CA) ..... 2479918

(51) Int. Cl.
*E02F 3/00* (2006.01)

(52) U.S. Cl. ..... 414/694; 212/302

(58) Field of Classification Search ..... 414/694, 414/708, 709; 280/763.1, 766.1, 754, 762, 280/727, 124.134, 124.104, 124.106, 124.107; 212/361, 302

See application file for complete search history.

(56) References Cited

U.S. PATENT DOCUMENTS 1,787,870 A * 1/1931 McWilliams ..... 280/754
2,350,701 A * 6/1944 Stueland ..... 212/285
2,963,183 A * 12/1960 Przybylski ..... 414/723
3,214,040 A * 10/1965 Willinger ..... 414/695.7
3,495,727 A 2/1970 Long
4,039,095 A * 8/1977 Long ..... 414/694
4,279,566 A * 7/1981 Sagaser et al. ..... 414/686

* cited by examiner

*Primary Examiner*—Donald Underwood
(74) *Attorney, Agent, or Firm*—Ogilvy Renault LLP

(57) ABSTRACT

A backhoe for quick connection to an end of an all-terrain vehicle (ATV) is described. A quick-connector mechanism is secured to a main mounting frame of the backhoe for securement to attaching components of an ATV. The backhoe has a pair of adjustable telescopic legs and a pivoting boom assembly, as is common with such apparatus. The pivoting boom assembly is connected to the main mounting frame of the backhoe by a piston operated pivoting mechanism for 180° lateral displacement of the boom assembly. The pivoting mechanism is comprised of a toothed sprocket secured to a vertical pivot connection at an attaching end of the boom assembly and fixedly secured to the main mounting frame. A sliding rack is provide with a series of teeth in toothed engagement with the toothed sprocket and secured for axial displacement by a fluid operated cylinder to cause the sprocket to turn and cause rotation of the pivot connection to thereby rotate the boom assembly within an arc of 180°.

22 Claims, 5 Drawing Sheets

BACKHOE FOR ALL-TERRAIN VEHICLES

TECHNICAL FIELD

The present invention relates to a backhoe for quick connection to an end of an all-terrain vehicle (ATV) and wherein a working implement is secured to the end of the boom assembly with a further quick connection.

BACKGROUND ART

Backhoe type excavation devices have been known for many years. It is also known to provide such backhoes for connection to small vehicles such as farm tractors, as described in U.S. Pat. No. 3,495,727, issued in 1970. In recent years smaller vehicles, such as all-terrain vehicles (ATV), have also been provided with all sorts of attachments and very recently with smaller backhoe structures. However, there are several disadvantages of these backhoe structures when secured to all-terrain vehicles as these backhoe structures are often too heavy and difficult to transport by a lightweight all-terrain vehicle. Also, some of these may not provide adequate security and may cause the vehicle to flip over during transport, causing injuries. A still further disadvantage of these backhoe structures is their ability to pivot along an adequate arc without having to constantly displace the small vehicle, which is time-consuming. A further disadvantage is the construction of the connection linkage to secure such backhoe devices to small all-terrain vehicles. These have been found to be time-consuming to connect and disconnect using bulky ad heavy connecting structures. Also, the working implement secured to the dipper stick of the boom is time-consuming to connect and disconnect.

Another disadvantage of attaching a small backhoe to an all-terrain vehicle (ATV) is that these vehicles have independent wheel suspensions and when transporting the load of the backhoe, the pair of wheels or one wheel of a pair of wheels can collapse under the weight of the backhoe structure and this makes it hazardous to an operator person and also can cause damage to the all-terrain vehicle. There is therefore a need to provide a backhoe for all-terrain vehicles and which substantially overcomes the above-mentioned disadvantages of the prior art.

SUMMARY OF INVENTION

According to a feature of the present invention there is provided a backhoe for all-terrain vehicles and which substantially overcomes all of the above-mentioned disadvantages of prior art backhoe structures connected to such small vehicles.

According to the above feature, from a broad aspect, the present invention provides a backhoe for quick connection to an end of an all-terrain vehicle (ATV). The backhoe comprises a main mounting frame having a quick-connector mechanism for securement to attaching components of an ATV. A pair of adjustable telescopic legs is displaceably secured to the main mounting frame. A seat assembly is secured above the mounting frame of the backhoe. A pivoting boom assembly is provided with a working implement at a free end thereof and is pivotally connected to the main mounting frame by a piston operated pivoting mechanism providing for 180° lateral arc displacement of the boom assembly. The pivoting mechanism has a toothed sprocket secured to a vertical pivot connection at an attaching end of the boom assembly which is fixedly secured to the main mounting frame. A sliding rack is provided with a series of teeth in toothed engagement with the toothed sprocket and is secured for axial displacement by controllable displacement means to cause the sprocket to turn and cause rotation of the pivot connection to thereby rotate the boom assembly.

According to a further broad aspect of the present invention there is provided a wheel suspension locking frame to interlock the suspension mechanism of a pair of front/rear wheels of an all-terrain vehicle (ATV). The locking frame comprises a rigid frame member having opposed extendable arms. The extendable arms are telescopically coupled to the rigid frame member. Releasable locking means is provided to interlock the extendable arms at a desired position with the rigid frame member. Each of the extendable arms have an abutment means at a free end thereof for abutting engagement with an opposed end member of the suspension to lock the suspension mechanism and prevent pivotal displacement thereof.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
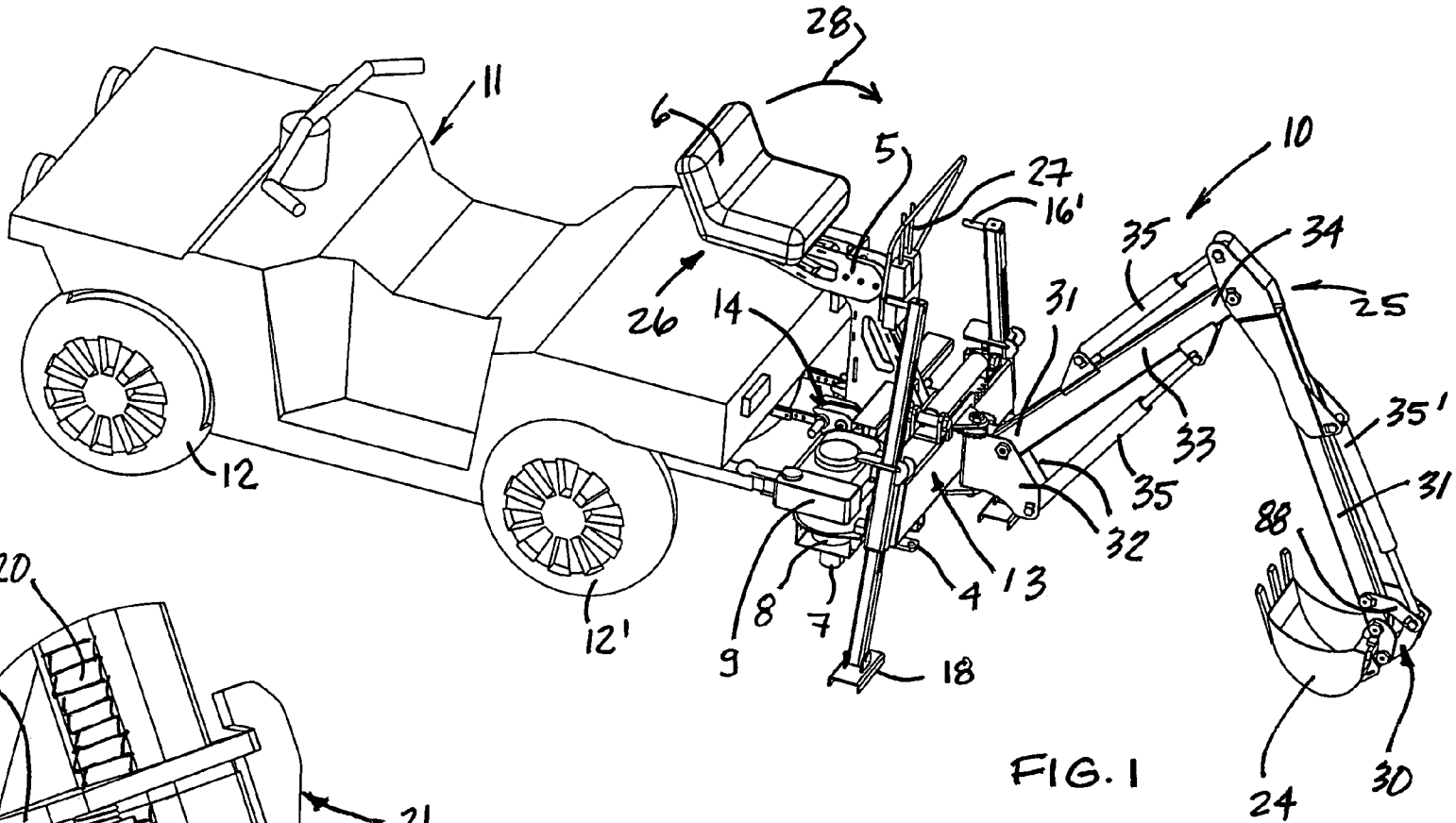
FIG. 1 is a perspective view of the backhoe, constructed in accordance with the present invention and connected to an all-terrain vehicle (ATV)
Figure 2:
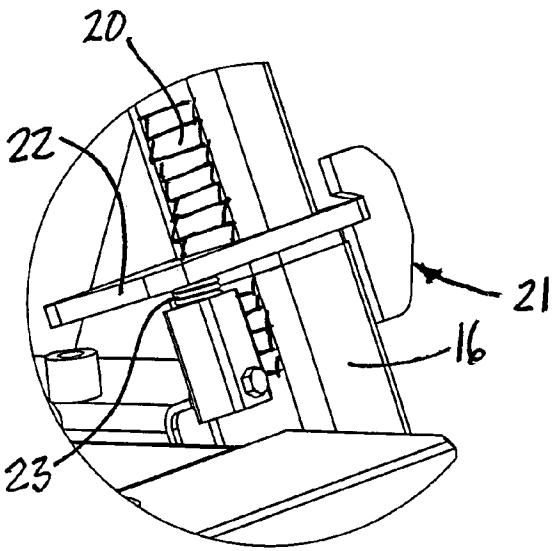
FIG. 2 is a fragmented perspective view showing the interlocking engagement of the telescopic legs with respect to the main frame of the backhoe.

Referring now to the drawings and more particularly to FIGS. 1 to 4, there is shown generally at 10 a backhoe constructed in accordance with the present invention and connected to an all-terrain vehicle (ATV) 11 of a type well known in the prior art. Such vehicles are constructed for traveling on rough terrain and accordingly the suspension of the front and rear wheels 12 and 12' thereof are mounted for independent operation as will be described later. The backhoe 10 of the present invention comprises a main mounting frame 13 which has a quick connector mechanism 14 for securement to attaching components 15 of the ATV 11, and as hereinshown to the rear of the ATV.

A pair of adjustable telescopic legs 16, herein constructed as hollow tubular metal rods, is secured to the main mounting frame through angulated guide channels 17 which are secured to opposed sides of the main mounting frame 13. A ground engaging pad 18 is pivotally connected at a lower end of the telescopic legs 16. The straight telescopic legs or rods 16 have a flat face 19 provided in a section thereof with a plurality of engageable teeth or ridges 20. These ridges are of triangular cross-section and have a sloping face and an abrupt retention face whereby to be engaged and released by a spring-biased latch 21 which is secured to each of the guide channels 17. The latch is provided with a tooth engaging plate 22, as better seen in FIG. 2, for locking engagement with one of the ridges 20 whereby to interlock the telescopic leg with the angulated guide channel at a desired position. The plate 22 prevents the legs from moving upwardly through the channels. The tooth engaging plate 22 is spring-biased by a spring mechanism 23 for engagement with a one of the toothed ridges. By depressing the tooth engaging plate 22 by the foot of an operator sitting on the seat 6, the latch is disengaged with the teeth and the telescopic leg 16 is released and slides by gravity through its channel. To retract the legs, the operator pulls on the handle 16' at the top of the leg and the latch releases on the slope faces of the ridges 20.

For engaging the ground engaging pads 18 onto a ground surface to immobilize the backhoe for use thereof, it is first necessary to place the bucket 24 on a ground surface and then by operating the pivoting boom assembly 25 the connecting end of the all-terrain vehicle 11 is caused to lift upwards. With the telescopic legs now retained elevated, the latch is released whereby the legs will fall by gravity onto the ground surface with the ground engaging pad 18 in engagement thereof. Both legs are placed in that working position and then the boom is ready to be operated with the connecting end of the ATV elevated above the ground. This procedure is well known in the art.

Figure 3:
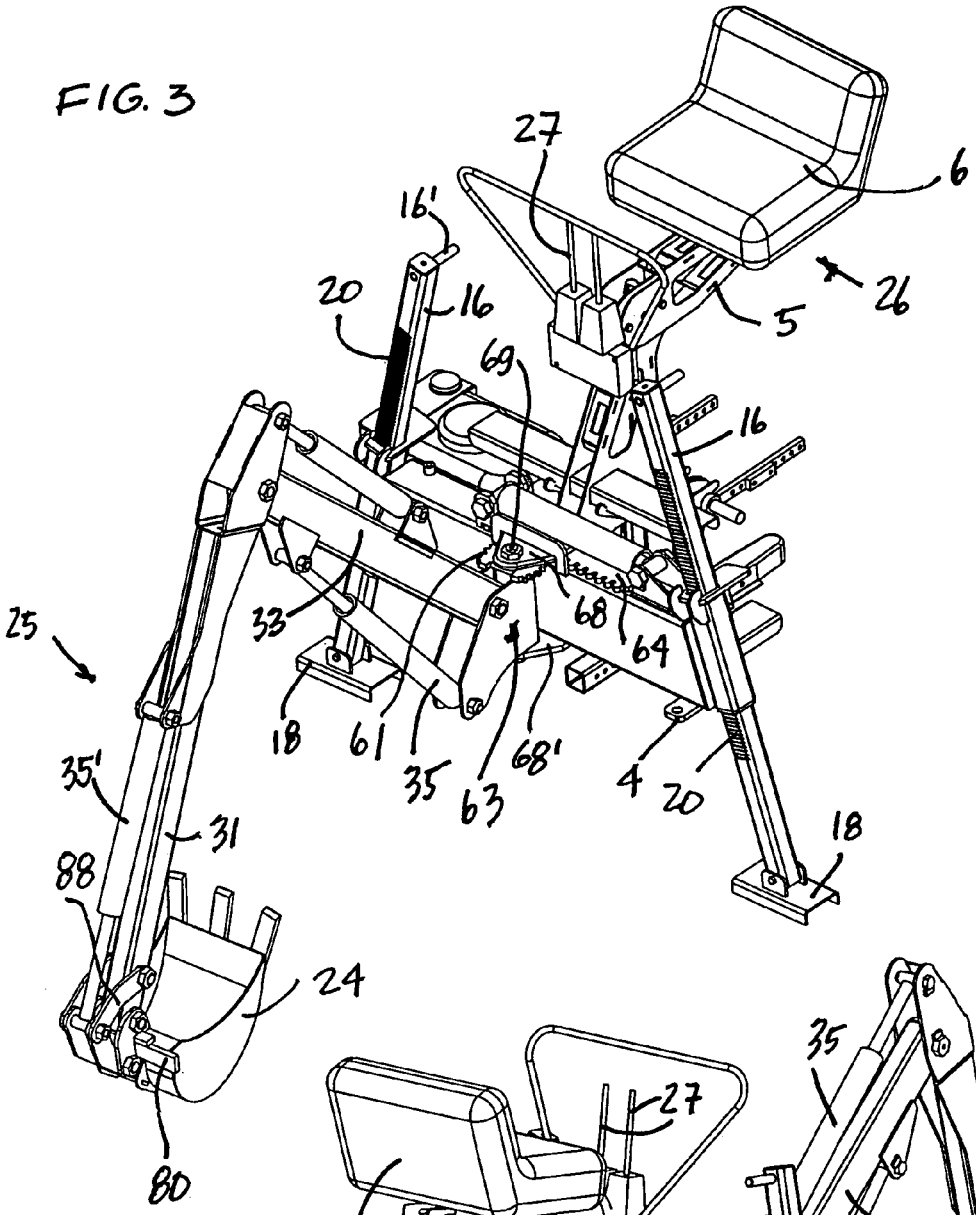
FIG. 3 is a front perspective view of the backhoe constructed in accordance with the present invention.
Figure 4:
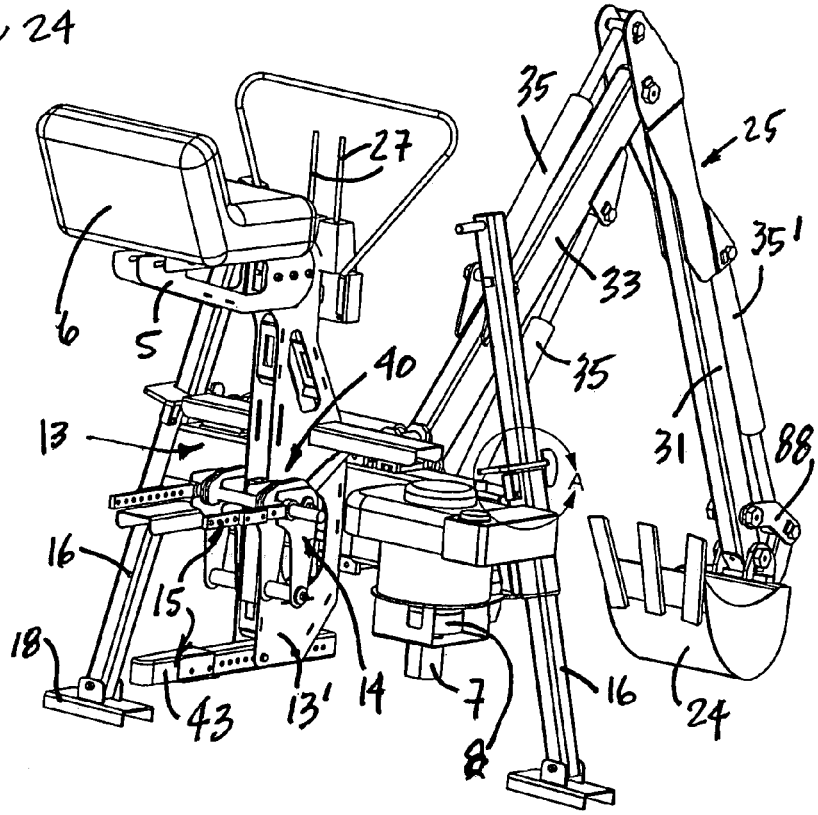
FIG. 4 is a rear perspective view of the backhoe constructed in accordance with the present invention.

As shown in FIGS. 1, 3 and 4, the backhoe is also provided with a seat assembly 26 which is mounted on a seat support bracket 5 and pivotally displaceable thereon to a forwardly inclined storage position, as indicated by arrow 28. The pivoting boom assembly 25 is hereinshown as provided with a bucket-type working implement 29 but other working implements can be connected to the free end connecting linkage 30 of the dipper stick 31.

The pivoting boom assembly 25 is pivotally connected at a near end 31 between vertical connecting flanges 32. The main pivoting boom 33 is pivotally connected at a far end 34 to the dipper stick 31. Piston cylinders 35 are provide for pivotal displacement of the pivoting boom 33, the dipper stick 31 and the working implement 29, as is well known in the art.

The backhoe 10 is further provided with a 5 horse power 4-stroke engine 9 which drives a 10 lb. fly wheel 8 connected to a hydraulic pump 7 for actuating the hydraulic pistons of the system by the use of control levers 27 disposed in front of the seat assembly 26. The weight of an operator sitting on the seat 6 counterbalances the load placed in the bucket 24. Attachment brackets 4 are connected to the main mounting frame 13 to connect a trailer thereto which may be used for transporting earth, stones or any other material picked up by the bucket 29.

Figure 5:
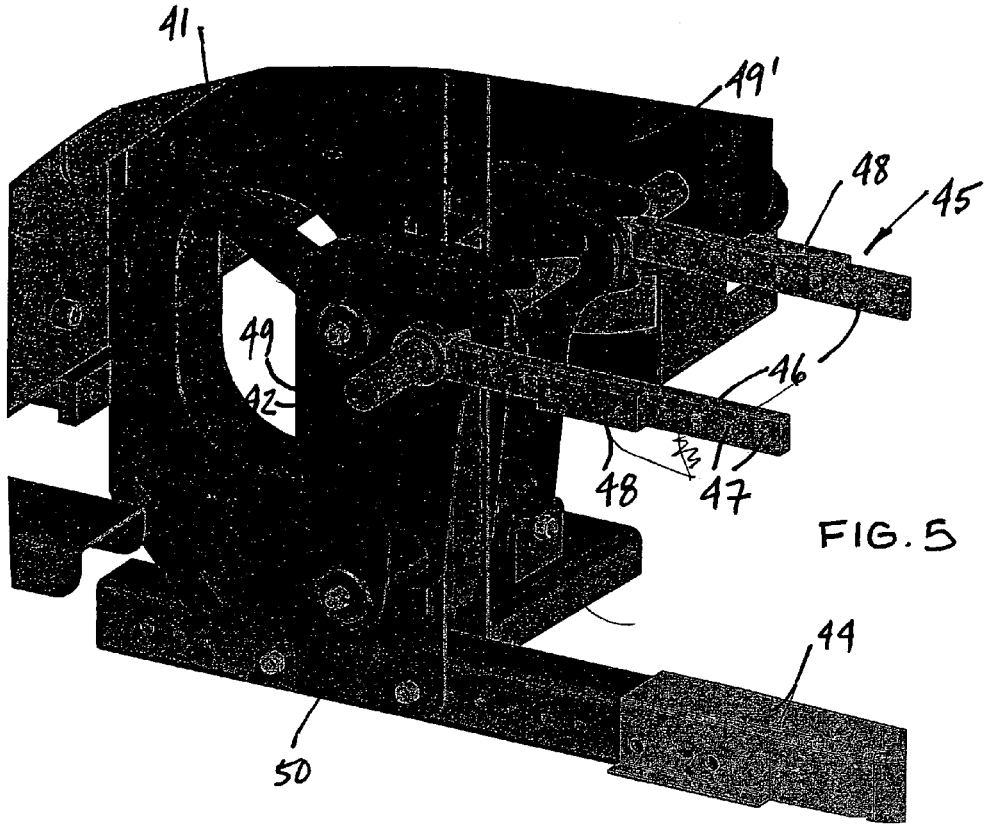
FIG. 5 is an enlarged perspective view showing the construction of the quick connector mechanism which attaches the backhoe to an end of an all-terrain vehicle.

An important feature of the backhoe structure of the present invention is its quick connector mechanism 14 which is better illustrated by FIGS. 4 to 6B. This quick connector mechanism comprises a bar clamping linkage 40 which is secured to the main mounting frame 13 and operated by a lever arm 41 for connection and disconnection to a horizontal attaching bar 42 secured to the all-terrain vehicle 11. The quick connector mechanism 14 further comprises a hitch connecting tongue 43 secured to the main mounting frame 13 and in alignment below the clamping linkage 40. The hitch connecting tongue 43 is adapted for sliding fit connection in a hitch socket 44, as shown in FIG. 5, also secured to the ATV vehicle.

The horizontal attaching bar 42 is immovably connected to an adjustable connector linkage 45 secured to a rigid frame of the ATV and projecting rearwardly thereof. The adjustable connector linkage is comprised of a pair of metal bars 46 each having a plurality of spaced apart through holes 47 for receiving connecting bolts (not shown) for adjustable connection to respective ones of immovable connecting bars 48 which are welded or otherwise immovably connected to the ATV vehicle.

Figure 6A:
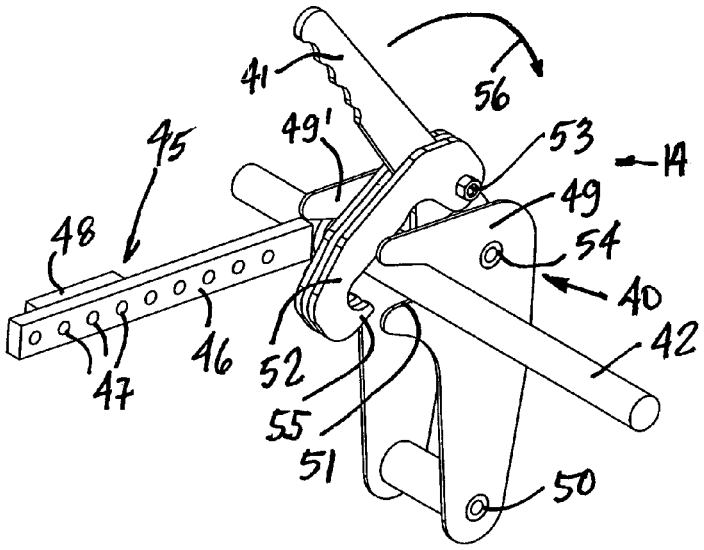
FIGS. 6A and 6B are perspective views showing the construction and operation of the quick connector mechanism.
Figure 6B:
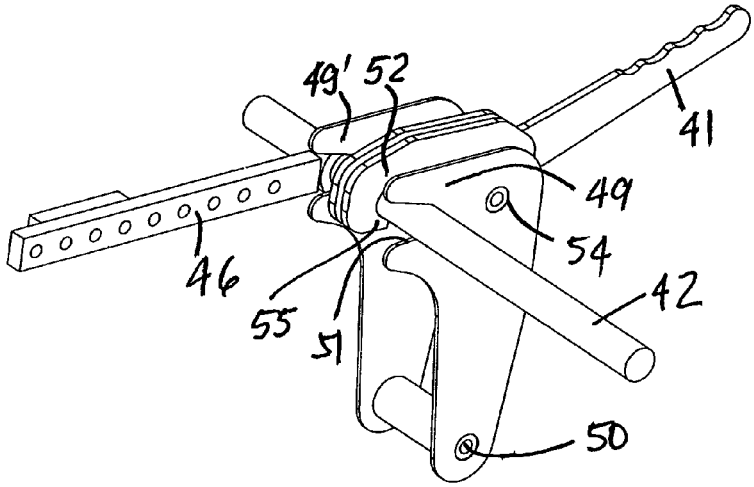

As shown more clearly in FIG. 4, the bar clamping linkage 40 comprises a pair of spaced-apart bar clamping assemblies secured on opposed sides of the vertical frame wall 13' of the main mounting frame 13. Each bar clamping assembly, as shown in FIGS. 6A and 6B, has a pair of spaced-apart clamping arms 49 and 49' pivotally connected at a lower end to the vertical frame wall 13' by pivot connection 50. An upper end of the clamping arms 49 is provided with a slot 51 for receiving the horizontal attaching bar or rod 42 extending thereacross. A clamping hook 52 is pivotally connected by its pivot connection 53 to the lever arm 41. The lever arm 41 is pivotally connected at a lower end by a pivot connection 54 and between the pair of spaced-apart clamping arms 49. The clamping hook 52 has a hook end 55 for grasping the horizontal attaching bar 42 and drawing it into the slots 51 of the clamping arms 49 and 49'. The lever 41 does this action by displacing it rearwardly in the direction of arrow 56 and when displaced to a connected position, as shown in FIG. 6B, the attaching bar 42 is pulled entirely within the connecting slots and retains the attaching bar in a clamped connected position. The pivoting points of the clamping hook and the lever arm are offset whereby the lever arm 41 is not forced to open by the linkage.

Figure 9:
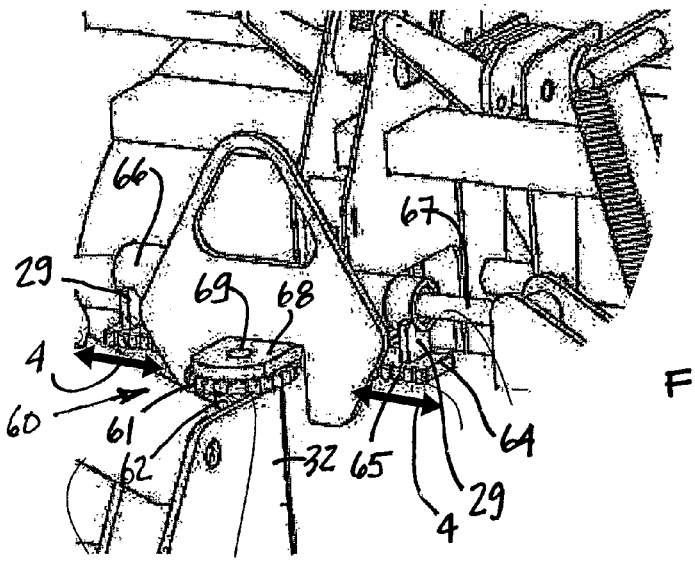
FIG. 9 is a perspective view illustrating the construction of the pivoting mechanism.

Referring now to FIGS. 1 and 9, there is illustrated another important feature of the present invention in the construction of a piston operated pivoting mechanism 60 whereby to provide 180° lateral arc displacement of the boom assembly 25. The pivoting mechanism is a simple mechanism which comprises a toothed sprocket 61 secured to a vertical pivot connection 62 at an attaching end 63 of the boom assembly 25 and fixedly secured to the main mounting frame 13. A sliding rack 64 is provided with a series of teeth 65 which are in toothed engagement with the toothed sprocket 61. The sliding rack 64 is secured to the cylinder housing 66 of cylinder 65 by securement brackets 29, as clearly illustrated in FIG. 9, whereby when the piston rod 67 of the cylinder 65 is extended, the rack is displaceable in the direction as indicated by arrows 4. The axial displacement of the toothed rack causes the sprocket to turn and impart a rotation to the boom assembly 25 within the 180° arc. Other means are conceivable for displacement of the sliding rack such as an electric motor provided with a driven gear coupled to the rack.

The vertical pivot connection 62 is comprised by a pair of spaced apart horizontal connecting flanges 68 and 68' extending substantially parallel to one another. A vertical pivot pin 69 is secured between the flanges and retained between the two spaced-apart vertical connecting flanges 32. Accordingly, the pivotal displacement of the boom assembly does not require a fluid operated piston connected to the boom to impart its arcuate displacement from side-to-side to achieve an unobstruded displacement of 180°, which was heretofore not possible with these small backhoe structures.

Figure 7:
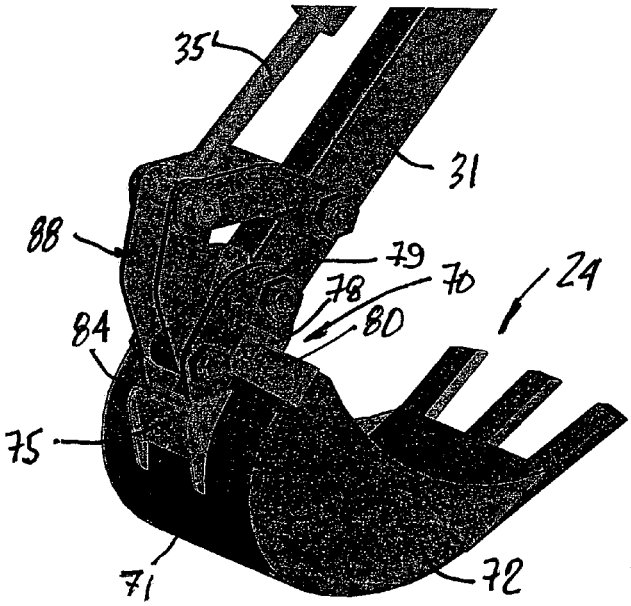
FIG. 7 is a perspective view showing the connection of a bucket to a free connecting end of the dipper stick of the boom assembly.
Figures 8A, 8B, 8C:
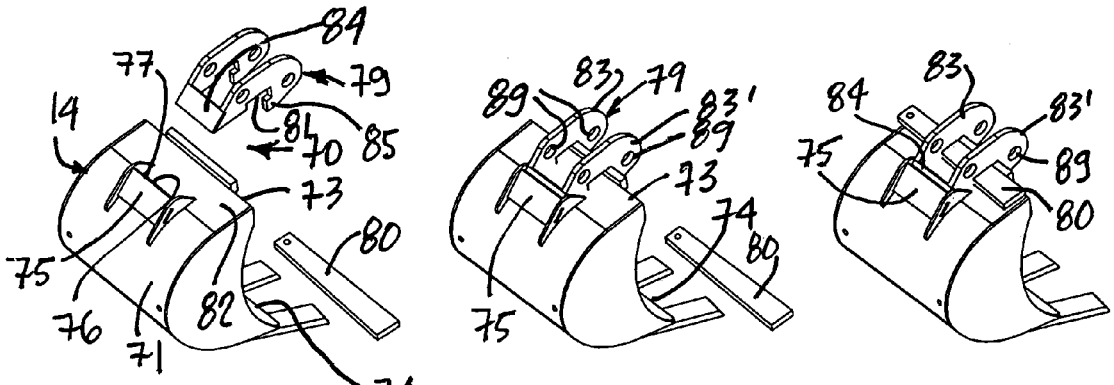
FIGS. 8A to 8C are perspective views showing the construction of the wedge connecting assembly and its connection to a bucket-type working implement.

As previously described, the working implement is a bucket and it is connected to the free end of the dipper stick 31 by a wedge connecting assembly 70 as illustrated in FIGS. 7 to 8C. This provides for quick connection and disconnection of the working implement to the free end of the dipper stick of the boom assembly. As shown in these Figures, the bucket 24 is formed by a curved rear wall 71 and opposed side walls 72. The curved rear wall 71 has a straight top edge 73 and a straight bottom edge 74 having digging teeth 74' secured thereto. The wedge connecting assembly 70 has a connecting member 75 secured to an outer surface of the curved rear wall 71 and spaced a predetermined distance from the straight top edge 73. A wedge retaining cavity 76 is formed by the connecting member 75 and has an open end 77 facing the straight top edge 73.

The wedge connecting assembly 70 is further provided with a projecting rib 78 which is immovably secured along the straight top edge 73. An interconnecting linkage 79 is provided for immovable connection between the connecting member 75 and the rib 78 by a wedge 80 disposed in a through slot 81 defined between the interconnecting linkage and the outer surface 82 of the curved rear wall 71 of the bucket 14.

The interconnecting linkage 79 comprises a pair of link arms 83 and 83' extending parallel to one another. A connecting wedge plate 84 is secured across the forward end of the link arms and is adapted for close-fit in the retaining cavity 76. The configured slot 81 is provided in each of the link arms 83 and 83' and are aligned with one another and a projecting rib 85 projects under a portion of these configured slots and faces the connecting wedge plate 84. The projecting rib 78 extends in the slots 81 with the configured rib extending thereunder and retained captive by the wedging force exerted by the wedge 80 when positioned across the slots 81 as shown in FIG. 8C. By removing the wedge with a large hammer, the bucket can be quickly disconnected and vice-versa.

The bucket 14 is also detachably secured to the free end of the dipper stick 31 of the boom assembly. In order to do so, the link arms 83 and 83' of the interconnecting linkage 79 are further provided with a pair of holes 89 to receive pivot pins for connection to the articulated linkage 88 of the dipper stick which is piston operated by the fluid cylinder 35', as shown in FIG. 1.

Figure 10:
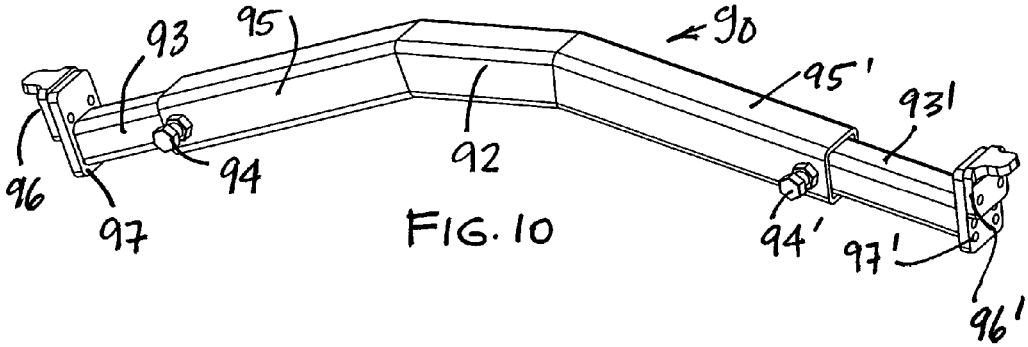
FIG. 10 is a perspective view showing the construction of a wheel suspension locking frame.
Figure 11:
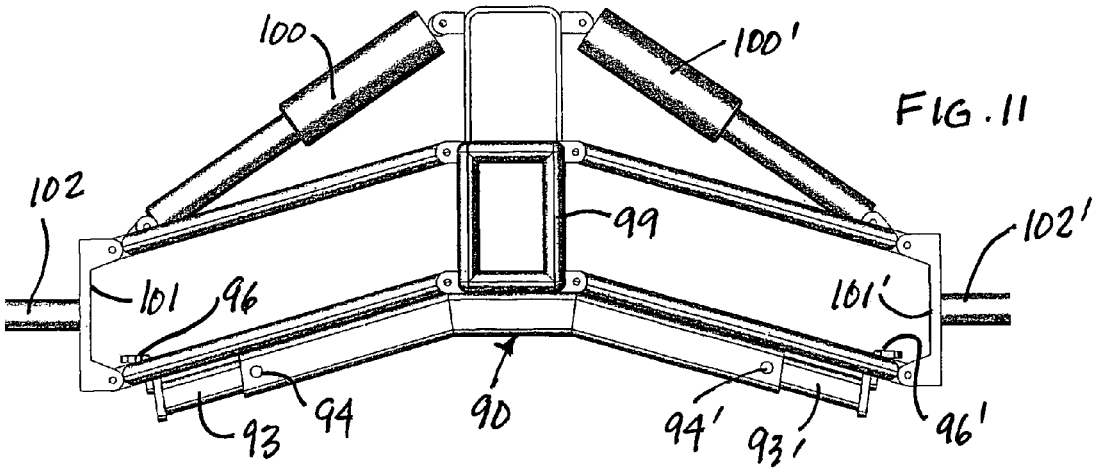
FIG. 11 is a plan view of the wheel suspension locking frame secured to a front or rear suspension mechanism of a pair of front or rear wheels of an all-terrain vehicle.

Referring now to FIGS. 10 and 11, there is shown another device associated with the present invention, in the form of a wheel suspension locking frame 90. This locking frame or bar interlocks the independent suspension mechanism 91, as illustrated in FIG. 11, of a pair of front or rear wheels of an all-terrain vehicle such as illustrated in FIG. 1. The locking frame 90 is comprised of a rigid frame member 92 which is provided with opposed extendable arms 93 and 93' at opposed ends thereof. The extendable arms are telescopically coupled to the rigid frame member 92. Releasable locking means, herein in the form of a threaded bolt 94, is provided in the hollow end sections 95 and 95' of the rigid frame member 92 for abutment against a respective one of the connecting end portions of the extendable arms 93 to arrest them at a desired position. As hereinshown the rigid frame member is a bar having at least hollow end sections and the extendable arms are received into these hollow end sections. In this embodiment, the frame member 92 is hollow throughout.

Each of the extendable arms 93 and 93' are provided with an abutment means hereinshown as right angle abutment finger elements 96 and 96' removably connected to connecting flanges 97 and 97' secured at the free end of each of the extendable arms. This abutment means may have different configurations depending on the construction of the suspension mechanism of the ATV vehicle, whereby to clamp thereto. This locking bar 90 can be installed in less than one minute.

As hereinshown, the rigid frame member 92 is a hollow tubular metal bar of rectangular cross-section. The extendable arms 93 and 93' are also tubular metal bars of smaller like cross-section for sliding fit in the ends thereof.

As shown in FIG. 10, the suspension mechanism 91 has a pivotal linkage 98 comprised of several link arms secured to a main frame 99 and shock cylinders 100 and 100'. The pivotal linkage 98 is connected between a wheel axle connecting frame 101 and 101' to which respective axles 102 and 102' are secured for mounting a pair of wheels thereon. The locking frame 90 is wedged between the axle connecting frame 101 and 101' to immobilize the pivotal linkage and accordingly the independent suspension mechanism of a pair of wheels. Accordingly, each wheel can no longer independently move with respect to its suspension mechanism. When displacing the ATV vehicle with the backhoe connected thereto on flat terrain, the wheel suspension locking frame can remain engaged or be disengaged if each wheel needs to be displaced over rough terrain. It is also necessary to counterbalance this backhoe when displacing the ATV and this can be done by placing sandbags or other weighted objects at the opposed end of the ATV vehicle.

It is within the ambit of the present invention to cover any obvious modifications thereof provided such modifications fall within the scope of the appended claims.

I claim:

1. A backhoe for quick connection to an end of an all-terrain vehicle (ATV), said backhoe comprising a main mounting frame having a quick-connector mechanism for securement to attaching components of an ATV, a pair of adjustable telescopic legs displaceably secured to said main mounting frame, a seat assembly secured above said mounting frame, a pivoting boom assembly having a working implement at a free end thereof is pivotally connected to said main mounting frame by a piston operated pivoting mechanism for 180° lateral arc displacement of said boom assembly, said pivoting mechanism having a toothed sprocket secured to a vertical pivot connection at an attaching end of said boom assembly and fixedly secured to said main mounting frame, a sliding rack having a series of teeth in toothed engagement with said toothed sprocket is secured for axial displacement by controllable displacement means to cause said sprocket to turn and cause rotation of said pivot connection to thereby rotate said boom assembly and a wheel suspension locking frame to interlock the suspension mechanism of a pair of front/rear wheels of an all-terrain vehicle, said locking frame comprising a bar having hollow end sections, an extendable arm telescopically received, at a connecting end portion thereof, in a respective one of said hollow end sections; releasable locking means to interlock said extendable arms at a desired position with said rigid frame member, each said extendable arms having an abutment means at a free end thereof for abutting engagement with an opposed end member of said suspension to lock said suspension mechanism and preventing pivotal displacement thereof.

2. A backhoe as claimed in claim 1 wherein said controllable displacement means is a displaceable fluid cylinder having a piston rod end thereof secured to said mounting frame to displace said cylinder along a straight axis, said sliding rack being immovably secured to said fluid cylinder.

3. A backhoe as claimed in claim 2 wherein said vertical pivot connection comprises a pair of spaced-apart horizontal connecting flanges extending substantially parallel to one another, a vertical pivot pin secured between said flanges, said pivot pin being retained between two spaced apart vertical connecting flanges secured to said boom assembly.

4. A backhoe as claimed in claim 3 wherein said boom assembly is comprised of a pivoting boom pivotally connected at a near end between said vertical connecting flanges, said pivoting boom being pivotally connected at a far end to a dipper stick, said dipper stick having said working implement secured at a free end thereof; and piston cylinders for pivotal displacement of said pivoting boom, dipper stick and working implement.

5. A backhoe as claimed in claim 4 wherein said working implement is secured to said free end of said dipper stick by a wedge connecting assembly for detachable securement to an actuating linkage connected at said free end of said boom assembly.

6. A backhoe as claimed in claim 5 wherein said working implement is a bucket formed by a curved rear wall and opposed side walls, said curved rear wall having a straight top edge and a straight bottom edge, said wedge connecting assembly having a connecting member secured to an outer surface of said curved rear wall and spaced a predetermined distance from said straight top edge, a retaining cavity formed by said connecting member and having an open end facing said straight top edge, a projecting rib immovably secured along said top straight edge, and an interconnecting linkage for immovable connection therebetween, said interconnecting linkage being interconnectable between said connecting member and said projecting rib by a wedge disposed in a through slot defined between said interconnecting linkage and said outer surface of said curved rear wall of said bucket.

7. A backhoe as claimed in claim 6 wherein said interconnecting linkage comprises a pair of link arms extending parallel to one another, a connecting wedge plate secured across a forward end of said link arm comprising said wedge and adapted for close-fit in said retaining cavity, a configured slot in each said link arm and aligned with one another, a projecting rib in each said link arm projecting under a portion of said configured slot and facing said connecting plate, said projecting rib extending in said slot with said configured ribs extending thereunder and retained captive by a wedging force exerted by said wedge.

8. A backhoe as claimed in claim 7 wherein said link arms of said interconnecting linkage are each further provided with a pair of holes to receive pivot pins for connection to said free end of said pivoting boom assembly and an articulated linkage which is piston operated to operate said bucket.

9. A backhoe as claimed in claim 1 wherein said quick-connector mechanism comprises a bar clamping linkage secured to said main mounting frame and operated by a lever arm for connection and disconnection to a horizontal attaching bar component securable to said ATV.

10. A backhoe as claimed in claim 9 wherein said quick-connector mechanism further comprises a hitch connecting tongue secured to said main mounting frame and in alignment below said bar clamping linkage, said hitch connecting tongue being adapted for sliding fit connection in a hitch socket securable to said ATV.

11. A backhoe as claimed in claim 10 wherein said horizontal attaching bar component is immovably connected to an adjustable connector linkage securable to a rigid frame of said ATV.

12. A backhoe as claimed in claim 11 wherein said adjustable connector linkage is comprised of a pair of metal bars each having a plurality of spaced apart through holes for receiving connecting bolts for adjustable connection to immovable connecting bars securable to said rigid frame of said ATV.

13. A backhoe as claimed in claim 11 wherein said bar clamping linkage comprises a pair of spaced-apart bar clamping assemblies secured on opposed sides of a vertical frame wall of said main mounting frame, each said bar clamping assemblies having a pair of spaced-apart clamping arms pivotally connected at a lower end to said vertical frame wall, an upper end of said clamping arms having a connecting slot for receiving said horizontal attaching bar therein and extending across said pair of spaced-apart clamping arms, and a clamping hook pivotally connected to said lever arm, said lever arm being pivotally connected at a lower end between said pair of spaced-apart clamping arms, said clamping hook having a hook end for grasping said horizontal attaching bar, said lever when displaceable to a connected position drawing said clamping hook to pull said attaching bar into said connecting slots of said clamping arms and retaining said attaching bar in a clamped connected position.

14. A backhoe as claimed in claim 1 wherein said pair of adjustable telescopic legs are each comprised of a straight telescopic rod having a flat face provided with a plurality of engageable ridges, a ground engaging pad pivotally connected at a lower end of said telescopic rod, an angulated guide channel secured to opposed sides of said main mounting frame and receiving a respective one of said telescopic legs in sliding fit therethrough, a spring-bias latch secured to said guide channel and provided with a tooth engaging plate for locking engagement with a ridge of said plurality of ridges to interlock said telescopic leg with said angulated guide channel.

15. A backhoe as claimed in claim 1 wherein said releasable locking means is a threaded bolt threaded in each said hollow end section of said bar for abutment against a respective one of a connecting end portion of said extendable arms to arrest them at said desired position.

16. A backhoe as claimed in claim 15 wherein said abutment means is a right angle abutment finger element removably connected to a connecting flange at said free end of each said extendable arm.

17. A backhoe as claimed in claim 1 wherein said suspension mechanism has a pivotal linkage connected between a wheel axle connecting frame of each wheel of said pair of wheels, said locking frame being wedged between said axle connecting frame to immobilize said pivotal linkage.

18. A wheel suspension locking frame to interlock the suspension mechanism of a pair of front/rear wheels of an all-terrain vehicle, said locking frame comprising a bar having hollow end sections, an extendable arm received at a connecting end portion thereof, in a respective one of said hollow end sections; releasable locking means to interlock said extendable arms at a desired position with said rigid frame member, each said extendable arms having an abutment means at a free end thereof for abutting engagement with an opposed end member of said suspension to lock said suspension mechanism and preventing pivotal displacement thereof.

19. A wheel suspension locking frame as claimed in claim 18 wherein said releasable locking means is a threaded bolt threaded in each said hollow end section of said bar for abutment against a respective one of a connecting end portion of said extendable arms to arrest them at said desired position.

20. A wheel suspension locking frame as claimed in claim 19 wherein said bar is a hollow tubular metal bar of rectangular cross-section, said extendable arm being a tubular metal bar of smaller like cross-section.

21. A wheel suspension locking frame as claimed in claim 19 wherein said abutment means is a right angle abutment finger element removably connected to a connecting flange at said fee end of each said extendable arm.

22. A wheel suspension locking frame as claimed in claim 18 wherein said suspension mechanism has a pivotal linkage connected between a wheel axle connecting frame of each wheel of said pair of wheels, said locking frame being wedged between said axle connecting frame to immobilize said pivotal linkage.

* * * * *